US011391200B2

(12) United States Patent
Karstadt et al.

(10) Patent No.: US 11,391,200 B2
(45) Date of Patent: Jul. 19, 2022

(54) COMPRESSOR HAVING AN ADJUSTMENT MECHANISM

(71) Applicant: BorgWarner Inc., Auburn Hills, MI (US)

(72) Inventors: Sascha Karstadt, Undenheim (DE); Waldemar Henke, Darmstadt (DE)

(73) Assignee: BorgWarner Inc., Auburn Hills, MI (US)

( * ) Notice: Subject to any disclaimer, the term of this patent is extended or adjusted under 35 U.S.C. 154(b) by 211 days.

(21) Appl. No.: 16/812,446

(22) Filed: Mar. 9, 2020

(65) Prior Publication Data

US 2020/0291852 A1 Sep. 17, 2020

(30) Foreign Application Priority Data

Mar. 12, 2019 (DE) ..... 102019203370.9

(51) Int. Cl.
*F02B 37/22* (2006.01)
*F02B 33/40* (2006.01)

(52) U.S. Cl.
CPC ..... *F02B 37/225* (2013.01); *F02B 33/40* (2013.01)

(58) Field of Classification Search
CPC ..... F02B 37/22; F02B 37/225; F04D 29/464
See application file for complete search history.

(56) References Cited

U.S. PATENT DOCUMENTS 8,573,929 B2 * 11/2013 Lombard ..... F02C 6/12 415/145
9,194,308 B2 * 11/2015 Iwata ..... F02B 37/24
10,107,296 B2 10/2018 Sun et al.
2012/0034071 A1 * 2/2012 Tabata ..... F04D 29/462 415/148

(Continued)

FOREIGN PATENT DOCUMENTS

DE 20 2014 102 773 7/2014
DE 202014102773 U1 7/2014
EP 3236077 A1 10/2017

(Continued)

OTHER PUBLICATIONS

Machine-assisted English language abstract for DE 20 2014 102 773 extracted from espacenet.com database on Apr. 1, 2020, 2 pages.

(Continued)

*Primary Examiner* — Ngoc T Nguyen
(74) *Attorney, Agent, or Firm* — Howard & Howard Attorneys PLLC

(57) ABSTRACT

This invention relates to a compressor 100 for a supercharger 10. The compressor 100 comprises a compressor housing 110 with a compressor inlet 112 and a compressor outlet 114. The compressor 100 furthermore comprises an adjustment mechanism 200 and an actuator device 300. The adjustment mechanism 200 comprises an adjustment ring 210 and a plurality of shutter elements 220 for changing an inlet cross section 112*a* of the compressor inlet 112. The (Continued)

actuator device 300 comprises a drive unit 310 and a coupling unit 320. The actuator device 300 is thus coupled, via the coupling unit 320, to the adjustment mechanism 200 in order to move the adjustment mechanism 200 between a first position and a second position.

15 Claims, 8 Drawing Sheets

(56) References Cited

U.S. PATENT DOCUMENTS

2014/0169949 A1* 6/2014 Tashiro ..... F02B 37/24
415/148
2015/0322965 A1* 11/2015 Hasegawa ..... F04D 17/122
415/150

FOREIGN PATENT DOCUMENTS

KR 2016-0048536 5/2016
KR 20160048536 A 5/2016

OTHER PUBLICATIONS

English language abstract and machine-assisted English translation for KR 2016-0048536 extracted from espacenet.com database on Apr. 1, 2020, 8 pages.

* cited by examiner

COMPRESSOR HAVING AN ADJUSTMENT MECHANISM

CROSS-REFERENCE TO RELATED APPLICATIONS

This application claims the benefit of German Patent Application No. 102019203370.9 filed Mar. 12, 2019, the disclosure of which is herein incorporated by reference in its entirety.

TECHNICAL FIELD

This invention relates to a compressor for a supercharger. The invention also relates to a supercharger having such a compressor.

BACKGROUND

More and more newer-generation vehicles are being equipped with superchargers in order to meet requirement targets and fulfill legal conditions. In the development of superchargers, the individual components as well as the system as a whole must be optimized in terms of reliability and efficiency.

Known superchargers usually have at least one compressor with a compressor wheel, which is connected to a drive unit by a common shaft. The compressor compresses the fresh air that is sucked in for the internal combustion engine or for the fuel cell. The volume of air or oxygen available to the engine for combustion or to the fuel cell for reaction is thus increased. This in turn leads to an increase in performance of the internal combustion engine or of the fuel cell. Superchargers can be equipped with different kinds of drive units. In particular e-chargers, in which the compressor is driven by an electric motor, and exhaust gas turbochargers, in which the compressor is driven by an exhaust gas turbine, are known to the prior art. Combinations of both systems are also described in the prior art.

Each compressor has a compressor-specific compressor characteristic map; the operation of the compressor being limited to the area of the compressor characteristic map between the surge line and the choke line. Depending upon the size and design of the compressor, the surge line may be reached in the event of low volumetric flows through the compressor; hence operation may be inefficient or no longer possible.

Known to the prior art in particular are compressors with adjustment mechanisms, which are arranged in the inlet zone of the compressor, upstream of the compressor wheel in the flow direction. The adjustment mechanisms can be used to vary the flow cross section in the compressor inlet; thus enabling, for example, the velocity and rate of the flow to the compressor wheel to be adjusted. This serves as a characteristic map-expanding measure, by which compressor surging can in turn be reduced or eliminated. Actuator devices, which must be connected to the adjustment mechanism, are required for actuating the adjustment mechanisms. This results in complex systems in terms of construction and control, and correspondingly large dimensions with increased installation space requirements, which in turn can result in design limitations.

The problem addressed by this invention is that of providing a compressor having an improved actuator device for an adjustment mechanism of a compressor.

SUMMARY OF THE INVENTION

This invention relates to a compressor for a supercharger according to Claim 1. The invention also relates to a supercharger having a compressor such as the one according to Claim 15.

The compressor for a supercharger comprises a compressor housing with a compressor inlet and a compressor outlet. The compressor also comprises an adjustment mechanism and an actuator device. The adjustment mechanism comprises an adjustment ring and multiple shutter elements for altering an inlet cross section of the compressor inlet. The actuator device comprises a drive unit and a coupling unit. The actuator device is coupled to the adjustment mechanism via the coupling unit for moving the adjustment mechanism between a first position and a second position. The drive unit can thus move the coupling unit, which in turn transfers the movement to the adjustment mechanism. The adjustment mechanism is designed to move in such a way that the shutter elements can reduce the inlet cross section or unblock it again. By virtue of the fact that the drive unit can move the adjustment mechanism directly via the coupling unit, a compact design is achievable. The implementation of the actuator device enables an implementation using just the drive unit and the coupling unit without the need of, for example, additional complicated transmission and/or gearbox units. In sum, it is possible to provide an improved compressor having a compact system of simple construction for stabilizing the compressor characteristic map.

In designs of the compressor, the coupling unit can comprise an oblong base body with a first end section and a second end section. The first end section can be coupled to the drive to unit. The second end section can be coupled to the adjustment mechanism. In other words, this means that the first end section can be coupled directly to the drive unit and that the second end section can be coupled directly to the adjustment mechanism.

In addition, the drive unit can be designed to move the coupling unit linearly along an axis of the oblong base body between a first position and a second position. As an alternative, the drive unit can be designed to move the coupling unit in rotation along an axis of the oblong base body between a first position and a second position.

In designs of the compressor which can be combined with the preceding design, the second end section can engage with the adjustment mechanism in such a way that the adjustment mechanism is in its first position in the first position of the oblong base body and that the adjustment mechanism is in its second position in the second position of the oblong base body.

In designs of the compressor which can be combined with any one of the preceding designs, the first position can correspond to an open position of the adjustment mechanism. The second position can correspond to a closed position of the adjustment mechanism. The inlet cross section is maximal in the open position of the adjustment mechanism. The inlet cross section is reduced in the closed position of the adjustment mechanism. In other words, this means that the inlet cross section is maximally reduced and not necessarily closed in the closed position of the adjustment mechanism. This means that the inlet cross section is minimal in the closed position of the adjustment mechanism. The inlet cross section is maximal in the open position of the adjustment mechanism.

In designs of the compressor which can be combined with any one of the preceding designs, at least one stop can be provided on the compressor housing. The stop can limit a movement of the coupling unit and/or a movement of the adjustment mechanism in the first position and/or in the second position. In particular, the stop can limit a movement of the adjustment ring and/or a movement of one or more of the shutter elements in the first position and/or in the second position. As an alternative, the adjustment mechanism can comprise at least one stop, which limits a movement of the shutter elements and/or of the adjustment ring in the first position and/or in the second position. The shutter elements comprise respective coupling elements, which are operatively coupled to corresponding shutter recesses in the adjustment ring so that the shutter elements can be moved via the adjustment ring. For example, the shutter recesses and/or the coupling elements can be configured in such a way that only maximum relative movement is possible, beyond which a type of tilting occurs which prevents a further relative movement of the shutter elements relative to the adjustment ring, in particular in the open position of the adjustment mechanism. The shutter elements can be configured and/or dimensioned in such a way that they, particularly in a closed position of the adjustment mechanism, touchingly contact the respective adjacent shutter elements. The adjacent shutter elements can come into touching contact, particularly in a circumferential direction, such that a further movement is prevented. A movement of the shutter elements and thus also a movement of the adjustment ring can thus be limited in the closed position of the adjustment ring. As an alternative, a limitation of the movement in the closed position can also be implemented by the aforementioned physical stop or by suitably designing the coupling elements and shutter recesses.

In designs of the compressor which can be combined with any one of the preceding designs, the drive unit can be a pneumatic, a hydraulic or an electric drive unit. In addition, the drive unit, if it is pneumatic, can be fluidically coupled to a line section downstream of the compressor outlet.

In designs of the compressor which can be combined with any one of the preceding designs, the compressor can furthermore comprise a fail-safe device. The fail-safe device is designed to move the adjustment mechanism into a safety position and hold it therein. For example, the fail-safe device can be configured to operate in the event that a (correct) functioning of the drive unit is impaired or if the latter is not working. For example, the fail-safe device can be activated by an interruption of the power supply and/or of the compressed air supply and/or an overload of the compressor. The safety position can correspond to the first position of the adjustment mechanism or to the second position of the adjustment mechanism. The fail-safe device is preferably designed to move the adjustment mechanism into its first position in which the inlet cross section is maximal. In other words, the safety position preferably corresponds to the first position of the adjustment mechanism and/or to the open position of the adjustment mechanism. The fail-safe device can comprise a spring element, for example.

In designs of the compressor which can be combined with the preceding design, the fail-safe device can be coupled to the drive unit. As an alternative, the fail-safe device can be coupled to the adjustment mechanism, in particular to the adjustment ring. A combined coupling to the drive unit and to the adjustment mechanism is also possible. If the fail-safe device is coupled to the drive unit, the fail-safe device can be designed to move the coupling unit in such a way that the coupling unit in turn moves the adjustment mechanism into the safety position. If the fail-safe device is coupled to the adjustment mechanism, the adjustment mechanism can also be moved into the safety position independently of the coupling unit and/or the drive unit in the event of, say, a defect in the coupling unit, in particular a breakage of the coupling unit.

In designs of the compressor which can be combined with any one of the preceding designs, the second end section can be in direct operative engagement with the adjustment ring. As an alternative, the second end section can be in direct operative engagement with one or a plurality of the shutter elements.

In designs of the compressor which can be combined with any one of the preceding designs in which the coupling unit is movable linearly along the axis of the oblong base body, the second end section can comprise one of either a recess or a protrusion. The adjustment ring can comprise the other of either a recess or a protrusion. The recess and the protrusion are in operative engagement with each other. In addition, and if the second end section comprises the recess, the recess can extend orthogonally to the axis of the oblong base body and orthogonally to the compressor axis. As an alternative and if the adjustment ring comprises a recess, the recess can extend in a radial direction. It is thus possible to compensate the radial offset between the coupling unit and the adjustment ring during the movement, since the coupling unit is moved tangentially to the adjustment ring. The coupling unit, in particular the oblong base body, is arranged in a direction tangential to the adjustment mechanism, in particular in a direction tangential to the adjustment ring. More precisely, the coupling unit or the oblong base body is arranged in a tangential direction of the compressor and offset radially inwards so that it can be coupled to the adjustment ring. A linear movement of the coupling unit can thus be converted to a rotary movement of the adjustment ring. The protrusion can extend substantially in an axial direction of the compressor into the recess. Additionally, the protrusion can extend substantially in an axial direction into the recess. The protrusion can be pin-shaped or bolt-shaped for example. As an alternative, the recess can be configured simply as a depression, e.g., as a groove. The first end section can be configured as, say, an extension of the oblong base body and coupled directly to the drive unit in order to receive a linear movement or absorb linear forces.

As an alternative to the preceding design, the second end section can comprise a three-joint mechanism. The three-joint mechanism is operatively coupled to the adjustment ring and designed to convert a linear movement of the coupling unit into a rotary movement of the adjustment ring. It is thus possible to compensate the radial offset between the coupling unit and the adjustment ring during the movement, since the coupling unit is moved tangentially to the adjustment ring.

In designs of the compressor which can be combined with any one of the preceding designs in which the coupling unit is movable linearly along the axis of the oblong base body, the compressor housing can comprise a drilled hole. The oblong base body can enter the compressor housing through the drilled hole. A bushing, in which the oblong base body is slidingly arranged, can also be arranged in the drilled hole. The drilled hole can also be arranged in a tangential direction (of the adjustment mechanism or of the adjustment ring). More precisely, the drilled hole is arranged in a tangential direction of the compressor and offset radially inwards.

In designs of the compressor which can be combined with any one of the preceding designs in which the coupling unit is movable in rotation along the axis of the oblong base body, the second end section can be fork-shaped or pin-shaped and project radially away from the axis of the oblong base body. The second end section can engage operatively with a corresponding depression in the adjustment ring or with a corresponding protrusion of the adjustment ring. In particular if the second end section is fork-shaped, it can engage operatively with a corresponding protrusion of the adjustment ring. The second end section can extend, in particular in an axial direction of the adjustment ring, into the depression of the adjustment ring. In particular, the second end section can engage operatively in an axial direction with the adjustment ring, i.e., with the depression or protrusion thereof. In the case of a depression, the latter can have a tangential gradient in order to compensate for a radial offset between the coupling unit and the adjustment ring during the movement. As an alternative or in addition, the second end section can also be configured as correspondingly smaller than the recess for the same purpose.

In designs of the compressor which can be combined with any one of the preceding designs in which the coupling unit is movable in rotation along the axis of the oblong base body, the first end section can comprise a lever and a rod coupled to the same. The lever can project radially away from the axis of the oblong base body. The rod can be coupled directly to the drive unit in such a way that the rod is movable linearly along its axis by the drive unit. A conversion of the linear movement of the rod into a pivot movement or rotation of the lever about the axis of the oblong base body is possible because the rod is arranged tangentially to the axis of the oblong base body (and offset radially outward from the axis of the oblong base body).

As an alternative to the preceding design, the drive unit can be designed to generate a rotary movement. For this purpose, the first end section can be coupled directly to the drive unit and designed to receive a rotary movement. For example, the first end section can be configured as an extension of the oblong base body and coupled directly to the rotary drive unit in order to receive a rotary movement or absorb rotary forces.

In designs of the compressor which can be combined with any one of the preceding designs in which the coupling unit is movable in rotation along the axis of the oblong base body, the compressor housing can comprise a drilled hole. The oblong body can enter the compressor housing through the drilled hole. In addition, a bushing in which the oblong body is rotatably mounted can be arranged in the drilled hole. In addition, the drilled hole can be arranged in a radial direction of the compressor or in an axial direction of the compressor.

In designs of the compressor which can be combined with any one of the preceding designs, the drive unit can be arranged directly on, in particular fastened to, the compressor housing.

In designs of the compressor which can be combined with any one of the preceding designs, the actuator device can furthermore comprise a control unit. The control unit can be designed to control the drive unit according to various operating modes of the compressor.

The invention furthermore relates to a supercharger comprising a drive device and a shaft. The supercharger furthermore comprises a compressor according to any one of the preceding designs. The compressor is coupled to the drive device, for conjoint rotation therewith, via the shaft. More precisely, the compressor wheel of the compressor is coupled to the drive device via the shaft. The drive device can comprise a turbine and/or an electric motor.

DETAILED DESCRIPTION

Figure 1A:
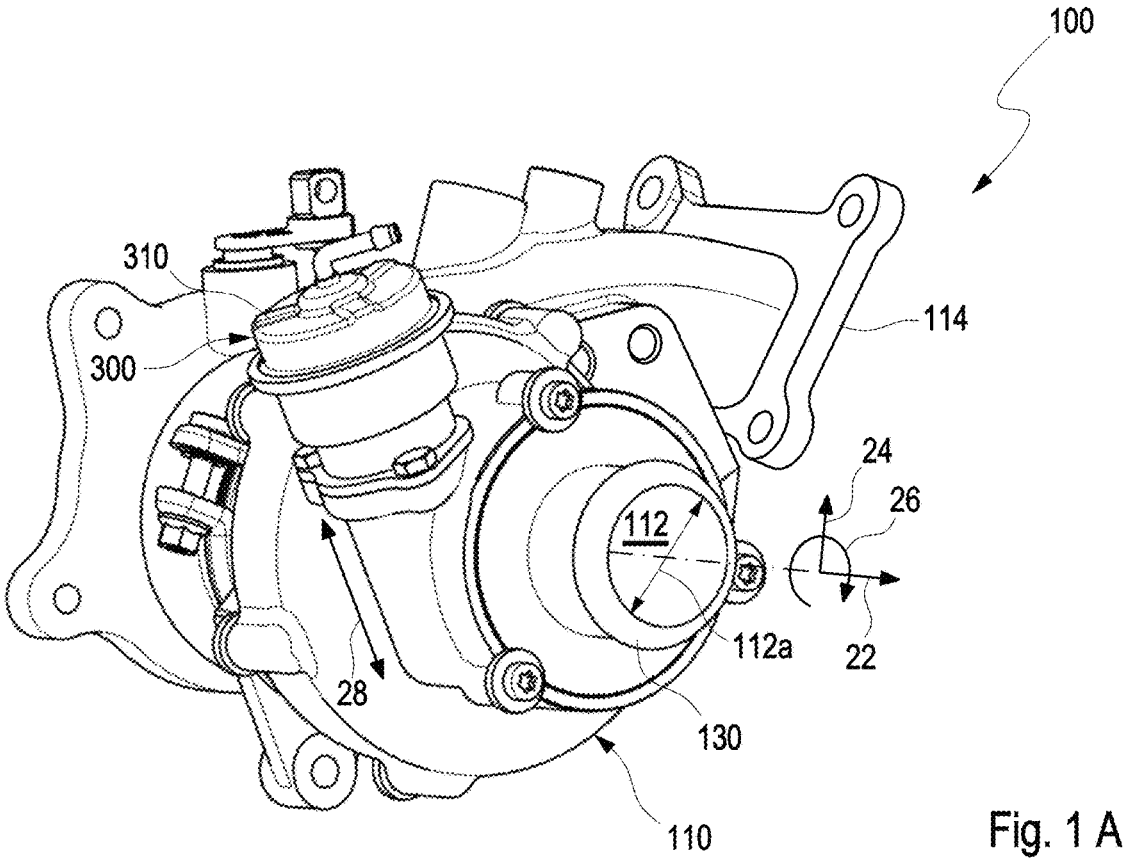
FIG. 1A shows a perspective view of a compressor with the actuator device.

In the context of this application, the expressions axial and axial direction relate to a rotation axis of the compressor 100 or of the adjustment ring 210. With reference to the figures (see for example FIG. 1A or FIG. 3), the axial direction of the compressor 100 or of the adjustment ring 210 is represented with the reference sign 22. A radial direction 24 relates to the axis 22 of the compressor 100 or of the adjustment ring 210. A circumference or a circumferential direction 26 likewise relates to the axis 22 of the compressor 100 or of the adjustment ring 210. A tangential direction 28 relates to an orientation substantially orthogonal to the radial direction 24. In principle, orientations and directions are to be interpreted according to these explanations, except when an axial/linear/radial/circumferential/tangential or other orientation/direction relates explicitly to another object (e.g., oblong base body).

Figure 1B:
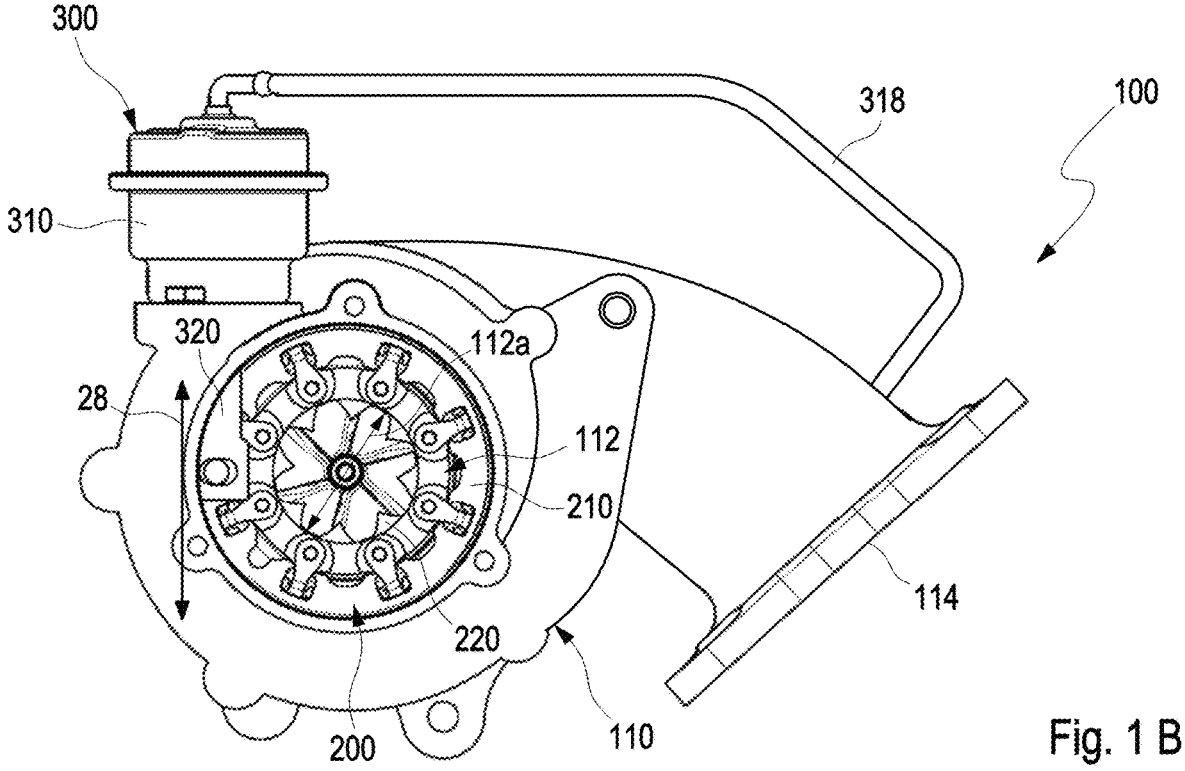
FIG. 1B shows a top view of the compressor from FIG. 1A without inlet nozzles, with the adjustment mechanism visible.
Figure 3:
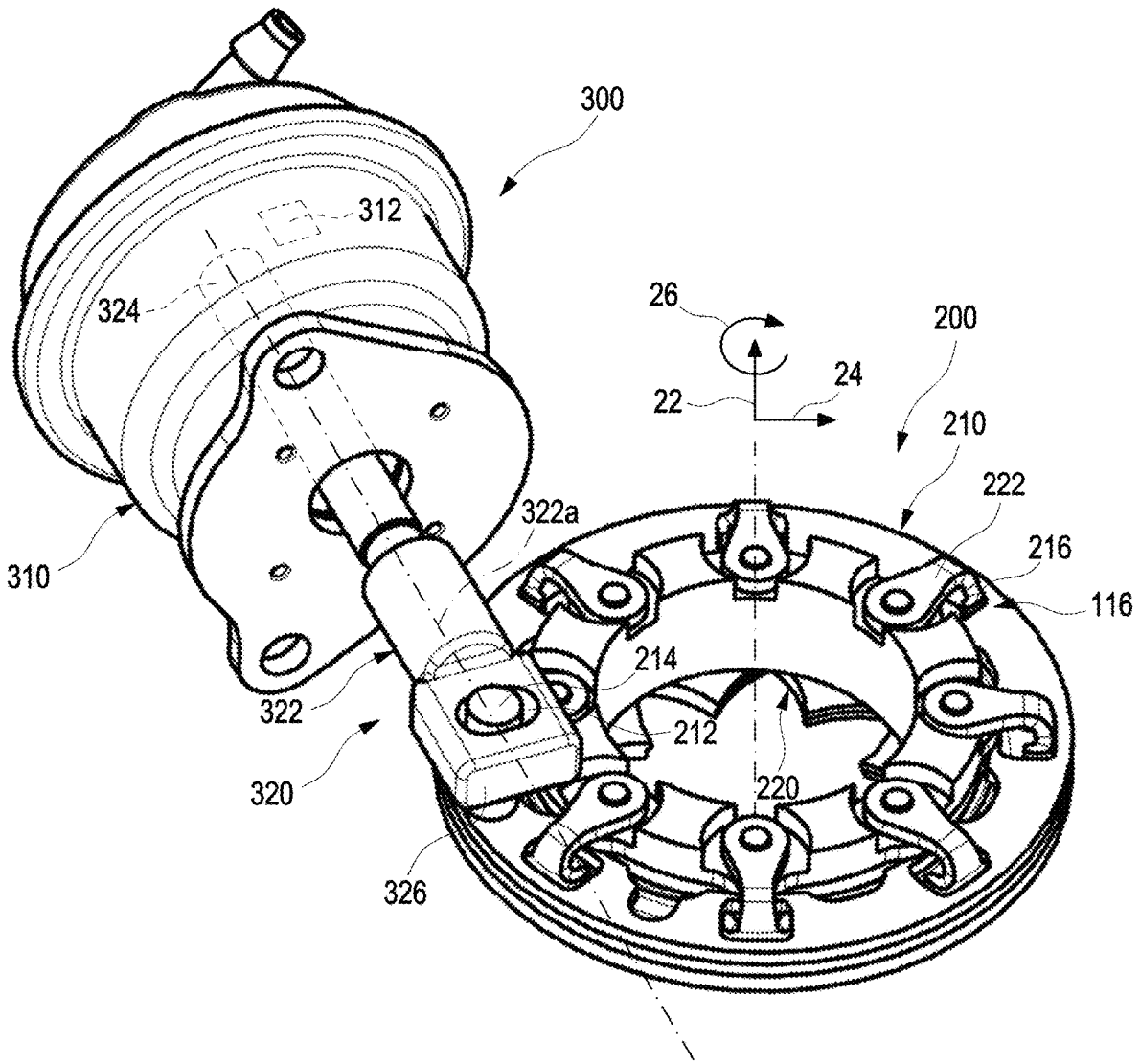
FIG. 3 shows, in a perspective view, how the actuator device and the adjustment mechanism according to a first design of a linearly movable coupling unit are intercoupled.

FIGS. 1A and 1B show the compressor 100 according to the invention for a supercharger 10. The compressor 100 comprises a compressor housing 110 having a compressor inlet 112 and a compressor outlet 114. The compressor 100 furthermore comprises an adjustment mechanism 200 and an actuator device 300. In FIG. 1A, an inlet nozzle 130 is mounted on the compressor housing 110, in the zone of the compressor inlet 112, which is why the adjustment mechanism 200 is only visible in FIG. 1B. The adjustment mechanism 200 comprises an adjustment ring 210 and multiple shutter elements 220 for changing an inlet cross section 112*a* of the compressor inlet 112. The actuator device 300 comprises a drive unit 310 and a coupling unit 320. The actuator device 300 is coupled to the adjustment mechanism 200 via the coupling unit 320 in order to move the adjustment mechanism 200 between a first position and a second position. In this process, the drive unit 310 can move the coupling unit 320, which in turn transmits the movement to the adjustment mechanism 200. The adjustment mechanism 200 is designed to move in such a way that the shutter elements 220 can reduce the inlet cross section 112*a* or unblock it again. This becomes clear upon examination of FIGS. 5A and 5B, which show a closed position and an open position, respectively, of the adjustment mechanism 200. The first position (FIG. 5B) corresponds to an open position of the adjustment mechanism 200 and the second position (FIG. 5A) corresponds to a closed position of the adjustment mechanism 200. The inlet cross section 112*a* is maximal in the open position of the adjustment mechanism 200. In contrast, the inlet cross section 112*a* is reduced in the closed position of the adjustment mechanism 200. In other words, this means that the inlet cross section 112*a* is maximally reduced but not necessarily closed in the closed position of the adjustment mechanism 200. This means that there is a minimal inlet cross section 112*a* in the closed position of the adjustment mechanism 200. The inlet cross section 112*a* is maximal in the open position of the adjustment mechanism 200. Various intermediate positions such as those illustrated in FIGS. 3 and 6B are also settable. The surge behavior of the compressor 100 can be improved by changing the inlet cross section 112*a*. In other words, a characteristic map-stabilizing measure (kennfeldstabilisierende Maßnahme (KSM)) or characteristic map-expanding measure can be implemented, which in turn improves the operational properties and operational range of the compressor. The fact that the drive unit 310 can move the adjustment mechanism 200 directly via the coupling unit 320 permits a compact design. Furthermore, the implementation of the actuator 300 enables an implementation solely by the drive unit 310 and the coupling unit 320 without the need of, for example, additional complicated transmission and/or gearbox units. In sum, provision can be made of an improved compressor 100 with a compact system with simple construction for stabilizing the characteristic map of the compressor 100.

The coupling unit 320 shall be explained in more detail with reference to FIGS. 3 and 5A. Basically, the coupling unit 320 comprises an oblong base body 322 with a first end section 324 and a second end section 326. The first end section 324 is coupled to the drive unit 310. The second end section 326 is coupled to the adjustment mechanism 200. In other words, this means that the first end section 324 can be coupled directly to the drive unit 310 (see for example FIG. 3) and that the second end section 326 can be coupled directly to the adjustment mechanism 200 (see for example FIGS. 5A and 5B). The second end section 326 is preferably in direct operative engagement with the adjustment ring 210. As an alternative or in addition, the second end section 326 can be in direct operative engagement with one or a plurality of the shutter elements 220. As an alternative to direct coupling, the first end section 324 can also be connected to the drive unit 310 via further elements (e.g., 325), as explained in detail further below with reference to FIG. 6A. The second end section 326 can likewise be connected to the adjustment mechanism 200 via further elements (e.g., 327), as explained in detail further below with reference to FIG. 4.

Figure 2A:
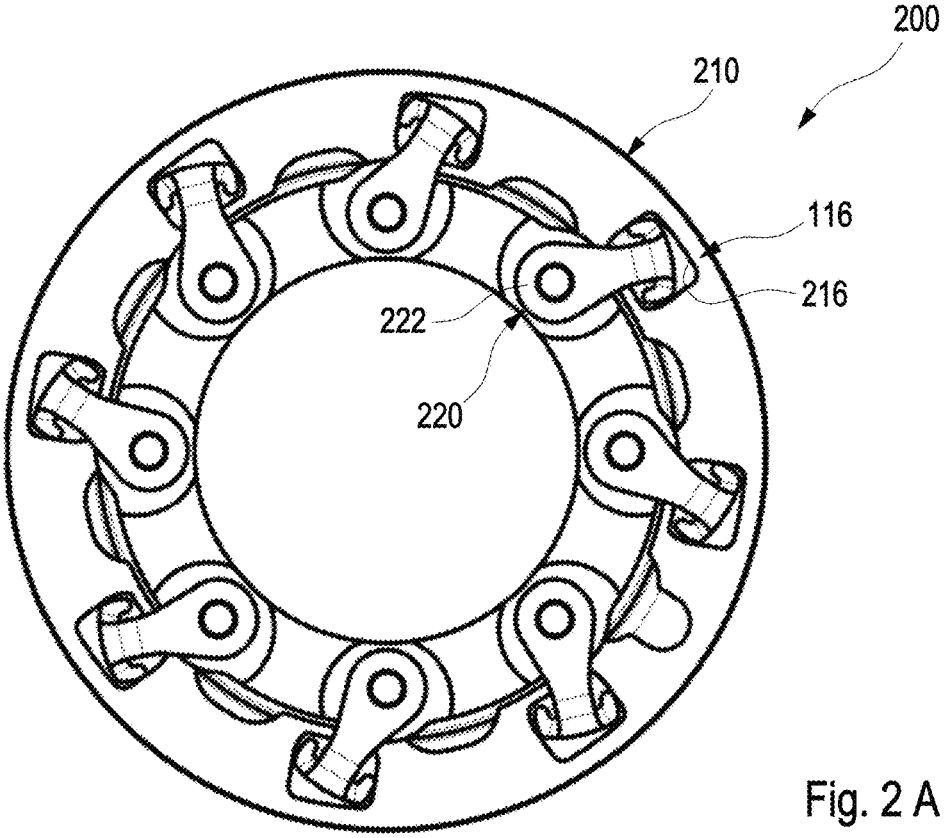
FIGS. 2A-2B show a view from above and a detailed view of the adjustment mechanism, from which the stop is discernible.
Figure 2B:
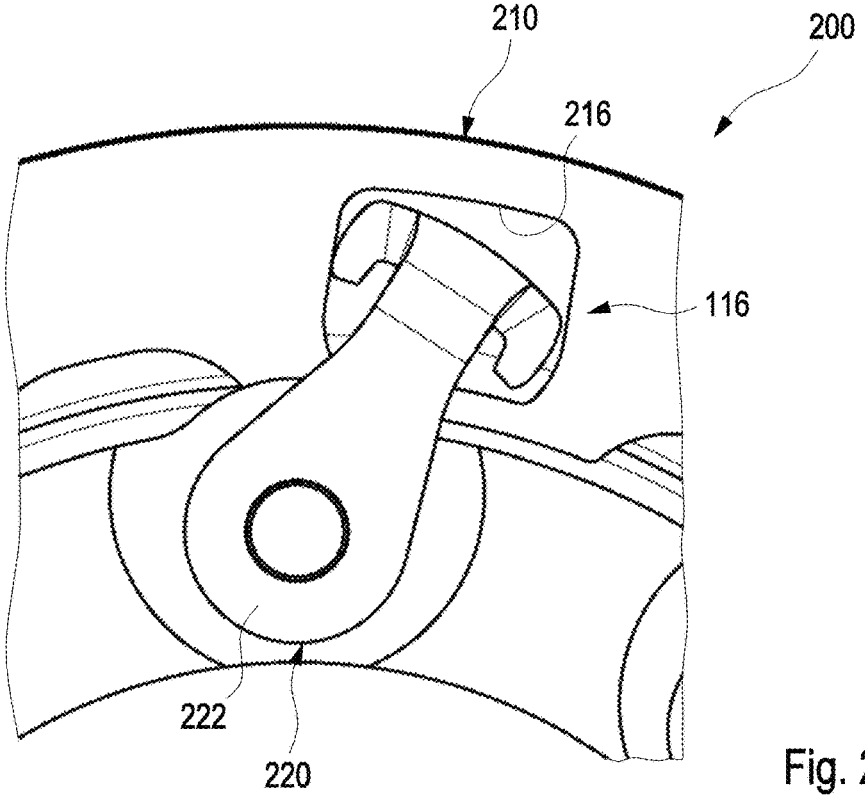

The adjustment mechanism 200 further comprises multiple stops 116 (see FIGS. 2A and 2B). The stops are designed to limit a movement of the shutter elements 220 and of the adjustment ring 210 in the first position and in the second position. Accordingly, the shutter elements 220 each comprise a coupling element 222. The adjustment ring 210 comprises corresponding shutter recesses 216, one for each coupling element 222. The coupling elements 222 are operatively coupled to the shutter recesses 216 so that the shutter elements 220 can be moved via the adjustment ring 210. The stops 116 are implemented by a suitable geometric designing and dimensioning of the coupling elements 222 and of the shutter recesses 216. For example, the shutter recesses 216 and/or the coupling elements 222 can be configured in such a way that only a maximum relative movement is possible, beyond which a type of tilting occurs that prevents any further relative movement of the shutter elements 220 relative to the adjustment ring 210, particularly in the open position of the adjustment mechanism 200 (see FIG. 2B). The shutter elements 220 can be configured and/or dimensioned in such a way that they, particularly in an open position of the adjustment mechanism 200, can touchingly contact the respective adjacent shutter elements 220. The adjacent shutter elements 220 can come into touching contact, particularly in the circumferential direction 26, such that any further movement is prevented (see FIG. 5A). A movement of the shutter elements 220 and consequently also a movement of the adjustment ring 210 in the closed position can thus be limited. This means that the stops 116 are implemented in the open position of the adjustment mechanism 200 by a corresponding geometric coordination of the coupling elements 222 and of the shutter recesses 216, and in the closed position of the adjustment mechanism 200 by a corresponding geometric designing of the shutter elements 220 or mutually abutting edges of the shutter elements 220. As an alternative to this, at least one (not illustrated) physical stop can be provided on the compressor housing 110. This can be implemented in the form of, for example, a projection or a protrusion, which protrudes from the compressor housing 110. The stop can limit a movement of the coupling unit 320 and/or a movement of the adjustment mechanism 200 in the first position and/or in the second position. In particular, the stop can limit a movement of the adjustment ring 210 and/or a movement of one or a plurality of the shutter elements 220 in the first position and/or in the second position.

In principle, a distinction can be made between two different designs of the coupling unit 320. The drive unit 310 can also be configured in correspondingly different ways. One of these designs is a linearly movable coupling unit 320 (see FIGS. 1A, 1B, 3, 4) and the other is a rotationally movable coupling unit 320 (see FIGS. 5A, 5B, 6A, 6B). This means that the drive unit 310 can be designed to move the coupling unit 320 linearly along an axis 322*a* of the oblong base body 322 between a first position and a second position. As an alternative, the drive unit 310 can be designed to move the coupling unit 320 in rotation along an axis 322*a* of the oblong base body 322 between a first position and a second position. In both embodiments, the second end section 326 engages with the adjustment mechanism 200 in such a way that, in the first position of the oblong base body 322, the adjustment mechanism 200 is situated in its first position. The second end section 326 furthermore engages with the adjustment mechanism 200 in such a way that, in the second position of the oblong base body 322, the adjustment mechanism 200 is situated in its second position.

The following embodiments relate to designs in which the coupling unit 320 is movable linearly along the axis 322*a* of the oblong base body 322. In the design according to FIG. 3, the second end section 326 comprises a recess 212 and the adjustment ring 210 comprises a protrusion 214. As an alternative, the second end section 326 can also comprise a protrusion 214 and the adjustment ring 210 a recess 212. The recess 212 and the protrusion 214 are in operative engagement with each other. In the example shown in FIG. 3, the recess 212 has an extension oriented orthogonally to the axis 322*a* of the oblong base body 322 and orthogonally to the compressor axis 22. As an alternative and if the adjustment ring 210 comprises the recess 212, the recess 212 can extend in a radial direction 24. A compensation of the radial offset between the coupling unit 320 and the adjustment ring 210 during the movement is thus achievable, since the coupling unit 320 is moved in a tangential direction 28 with respect to the adjustment ring 210. The coupling unit 320, in particular the oblong base body 322, is thus arranged in a tangential direction 28 with respect to the adjustment mechanism 200, particularly in a tangential direction 28 with respect to the adjustment ring 210. More precisely, the coupling unit 320 or the oblong base body 322 is arranged in a tangential direction 28 of the compressor 100 and offset inwardly in a radial direction 24 so that it can be coupled to the adjustment ring 210. A linear movement of the coupling unit 320 can thus be converted to a rotary movement of the adjustment ring 210. The protrusion 214 can extend substantially in an axial direction 22 of the compressor 100. The protrusion 214 can furthermore extend in a substantially axial direction 22 into the recess 212. The protrusion 214 can be bolt-shaped or pin-shaped, for example. As an alternative, the recess 212 can be configured simply as a depression, e.g., as a groove. The first end section 324, for example, can be configured as an extension of the oblong base body 322 and coupled directly to the drive unit 310 (indicated by dashed lines in FIG. 3), in order to receive a linear movement or absorb linear forces.

Figure 4:
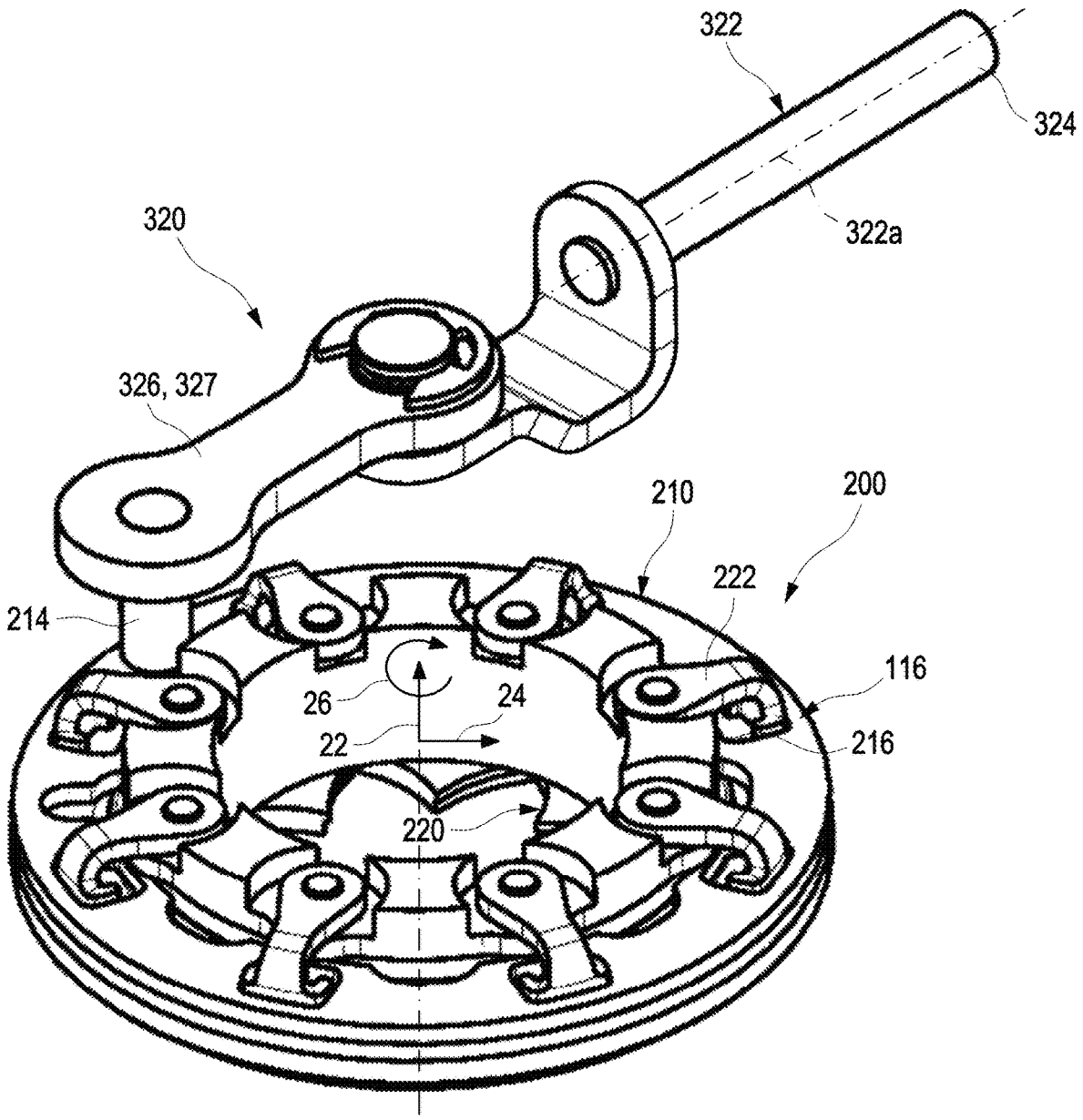
FIG. 4 shows, in a perspective view, how the actuator device and the adjustment mechanism according to a second design of a linearly movable coupling unit are intercoupled.
Figure 7:
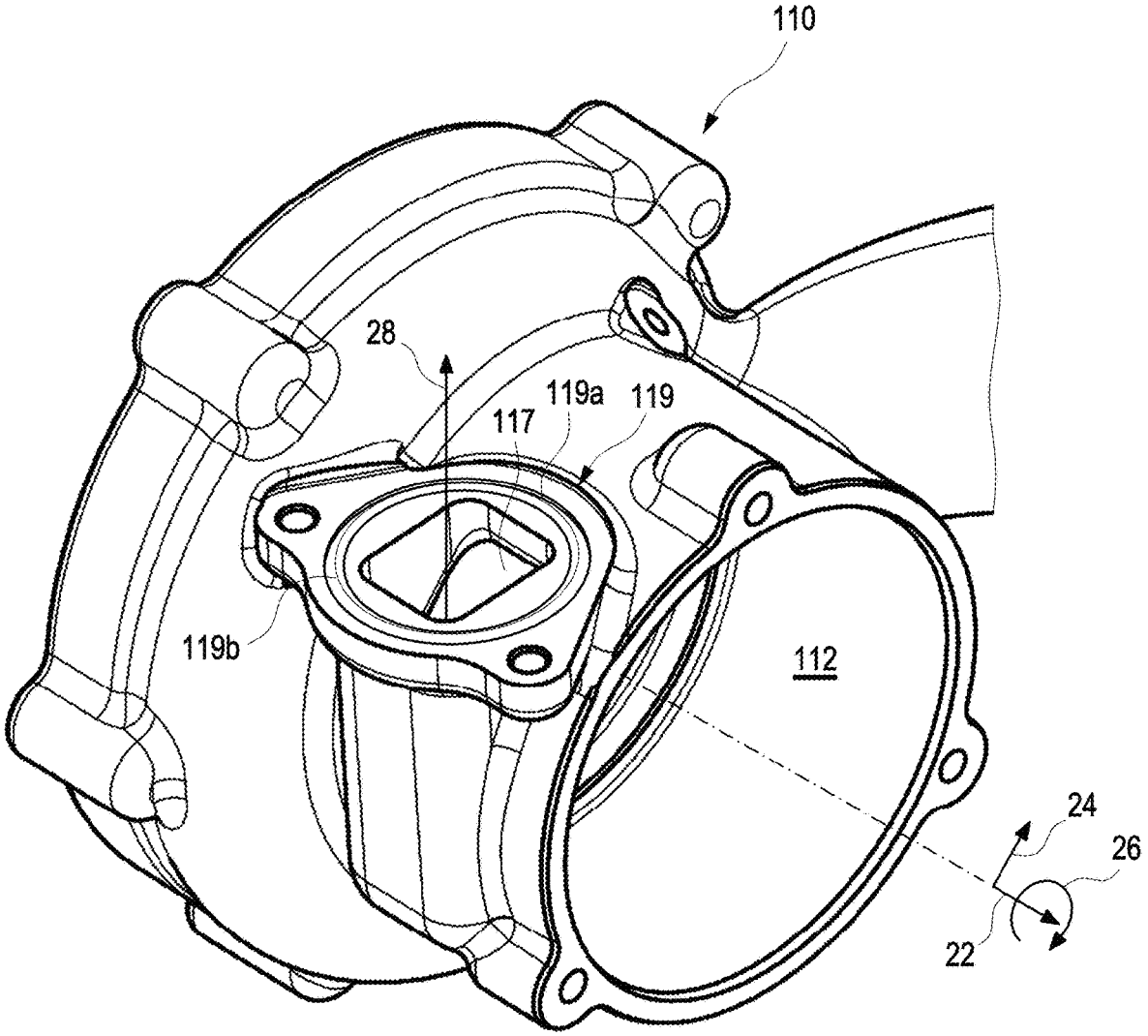
FIG. 7 shows the compressor housing in a perspective view, with a flange and gasket for coupling to the actuator device.

As an alternative to the preceding design, the second end section 326 can comprise a three-joint mechanism 327 (see FIG. 4). The three-joint mechanism 327 is operatively coupled to the adjustment ring 210 and designed to convert a linear movement of the coupling unit 320 into a rotary movement of the adjustment ring 210. A compensation of the radial offset between the coupling unit 320 and the adjustment ring 210 during the movement is thus achievable, since the coupling unit 320 is moved tangentially with respect to the adjustment ring 210. The compressor housing 110 comprises a drilled hole 117 (see FIG. 7). The oblong base body 322 can enter the compressor housing 110 through the drilled hole 117. A bushing, in which the oblong base body 322 is slidingly arranged, can also be arranged in the drilled hole 117 (shown only in the context of a rotationally movable coupling unit 320). In addition, the drilled hole 117 can be arranged in a tangential direction 28 (of the adjustment mechanism 200 or of the adjustment ring 210). More precisely, the drilled hole 117 is arranged in a tangential direction 28 of the compressor 100 and offset inwardly in a radial direction 24.

Figure 5A:
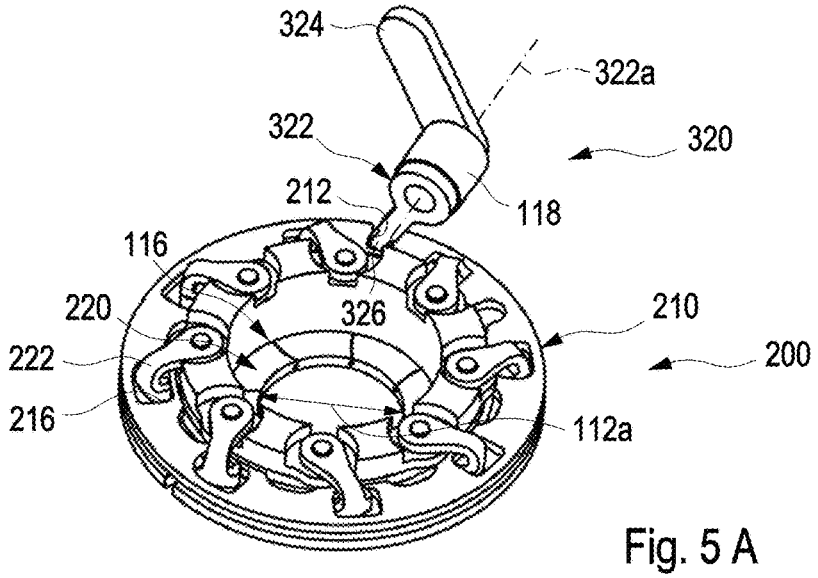
FIGS. 5A-5B show, in perspective views, how the actuator device and the adjustment mechanism according to a first design of a rotationally movable coupling unit are intercoupled when the adjustment mechanism is in a closed position (FIG. 5A) and in an open position (FIG. 5B)
Figure 5B:
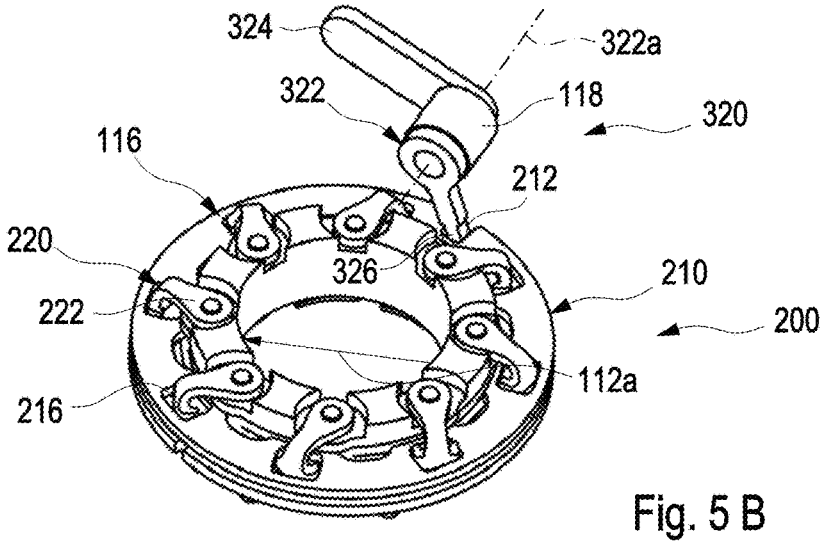
Figure 5C:
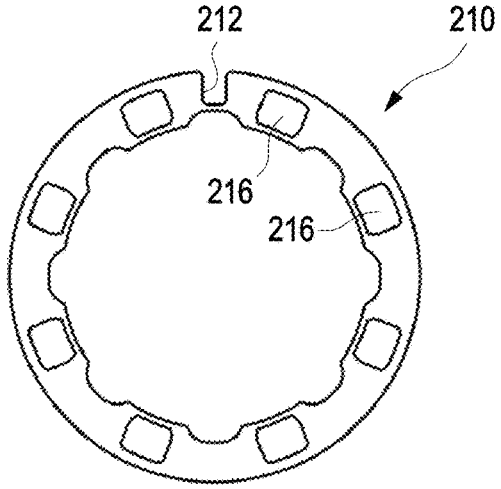
FIG. 5C shows the design of the adjustment ring for a rotationally movable coupling unit in a view from above.

The following embodiments relate to designs in which the coupling unit 320 is movable in rotation along the axis 322*a* of the oblong base body 322, and in which the second end section 326 is fork-shaped (see FIGS. 6A and 6B) or pin-shaped (see FIGS. 5A and 5B). The second end section 326 projects radially away from the axis 322*a* of the oblong base body 322. The second end section 326 is in operative engagement with a corresponding recess 212 in the adjustment ring 210. As an alternative or in addition, the second end section 326 can be coupled to a corresponding protrusion 214 of the adjustment ring 210. In particular, this is the case if the second end section 326 is fork-shaped (see FIGS. 6A and 6B). The second end section 326 can extend, in particular in an axial direction 22 of the adjustment ring 210, into the depression 212 of the adjustment ring 210. In particular, the second end section 326 can engage operatively, in the axial direction 22, with the adjustment ring 210, i.e., engage operatively with the depression 212 and/or protrusion 214 thereof. In the case of a depression 212, the latter can have an extension in a tangential direction 28 in order to compensate for a radial offset between the coupling unit 320 and the adjustment ring 210 during the movement. As an alternative or in addition, for the same purpose the second end section 326 can be configured, at least in a region which engages with the recess, as correspondingly smaller than the recess 212, as shown in FIGS. 5A and 5B. As can be inferred from FIG. 5C in particular, the recess 212 can also have an extension in a radial direction 24 and optionally be open to the outside in a radial direction 24. As an alternative, the recess 212 can also be configured simply as a depression, e.g., as a groove.

Figure 6A:
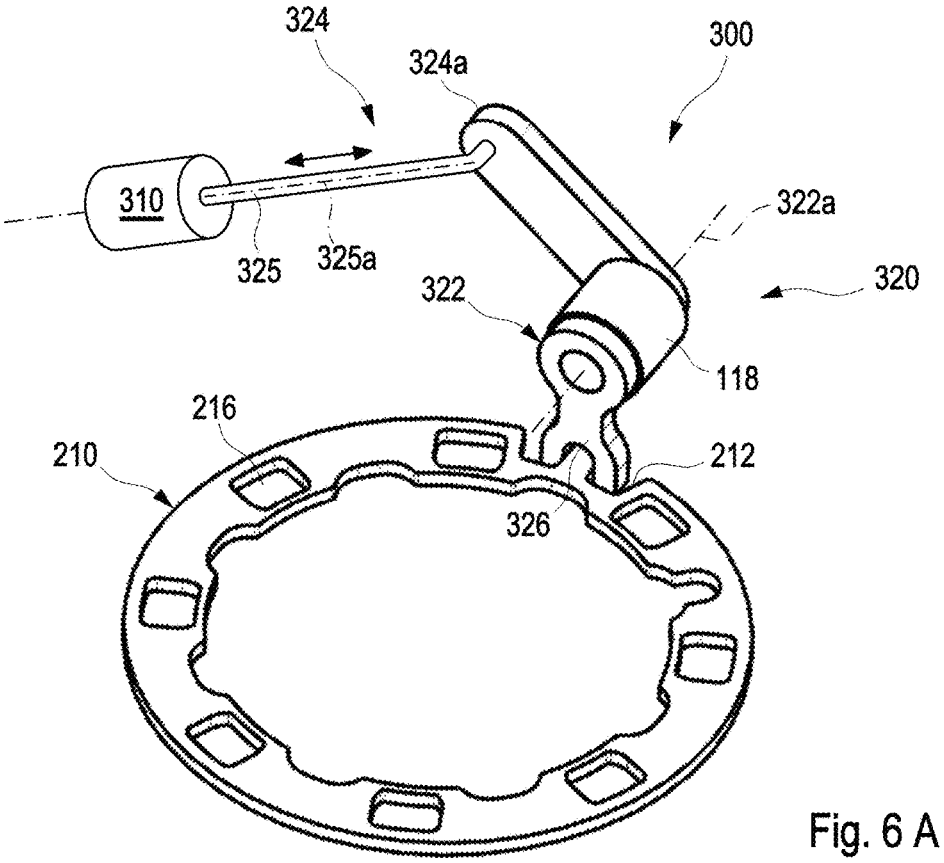
FIG. 6A shows, in a perspective view, how the actuator device and the adjustment ring according to a second design of a rotationally movable coupling unit are intercoupled.
Figure 6B:
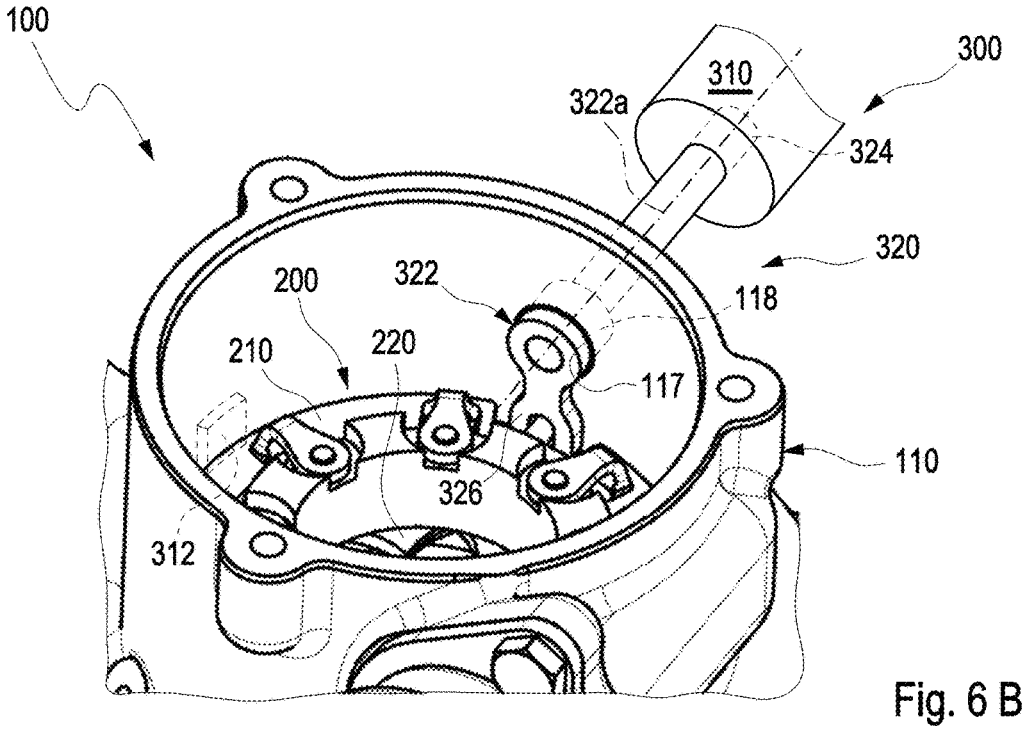
FIG. 6B shows the coupling according to FIG. 6A installed in a compressor.

As shown in the example of FIG. 6A, the first end section 324 can comprise a lever 324*a* and a rod 325 coupled thereto. In a manner similar to the coupling of the second end section 326 and the adjustment ring 210 from FIG. 3, the lever 324*a* can have a groove-like recess (not illustrated) in order to compensate for a radial offset relative to the axis 322*a* of the oblong base body 322. The lever 324*a* projects radially away from the axis 322*a* of the oblong base body 322. The rod 325 is coupled directly to the drive unit 310 in such a way that the rod 325 is movable linearly along its axis 325*a* by the drive unit 310. A conversion of the linear movement of the rod 325 into a pivot movement or a rotation of the lever 324*a* about the axis 322*a* of the oblong base body 322 is possible because the rod 325 is arranged tangentially with respect to the axis 322*a* of the oblong base body 322 (and offset radially outwards from the axis 322*a* of the oblong base body 322). Although this example is shown only in the context of a fork-shaped second end section 326, it is equally applicable in a design with a pin-shaped second end section 326 and should therefore not be construed as a limitation to such a design.

As an alternative to the preceding design, the drive unit 310 can be designed to generate a rotary movement (see FIG. 6B). For this purpose, the first end section 324 is coupled directly to the drive unit 310 and designed to receive a rotary movement. The first end section 324 is configured as an extension of the oblong base body 322 and is coupled directly to the rotary drive unit 310 in order to receive a rotary movement or absorb rotary forces. Although this example is shown only in the context of a fork-shaped second end section 326, it is equally applicable in a design with a pin-shaped second end section 326 and should therefore not be construed as a limitation to such a design.

As illustrated by way of example in FIG. 6B, the compressor housing 110 comprises a drilled hole 117. The oblong base body 322 can enter the compressor housing 110 through the drilled hole 117. A bushing 118 (not visible), in which the oblong base body 322 is rotatably mounted, is also arranged in the drilled hole 117. The drilled hole 117 is arranged in the compressor housing 110 in a radial direction 24 of the compressor 100. As an alternative, the drilled hole 117 can be arranged in the compressor housing 110 in an axial direction 22 of the compressor 100.

The following statements again relate to both designs of the coupling unit 320—i.e., to both linearly movable and rotationally movable coupling units 320.

In the examples shown, the drive unit is configured as a pneumatic drive unit 310 (e.g., FIG. 1A) or as an electric drive unit 310 (e.g., FIG. 6B). As an alternative, the drive unit could also be configured as, say, a hydraulic drive unit 310. In designs in which the drive unit 310 is pneumatic, the drive unit 310 can be fluidically coupled with a line section 318 downstream of or in the area of the compressor outlet 114, as indicated schematically in FIG. 1B. What is essential here is that the line section 318 is arranged or coupled in the high-pressure range of the compressor 100. This means that the line section 318 can be arranged downstream of the compressor wheel 120. The advantage of this is that the drive unit 310 can be controlled in a self-regulating manner directly via the high-pressure range of the compressor 100.

The compressor 100 furthermore comprises a fail-safe device 312. This fail-safe device 312 is illustrated schematically in FIGS. 3 and 6B. The fail-safe device 312 is designed to move the adjustment mechanism 200 into a safety position and hold it therein. For example, the fail-safe device 312 can be configured to operate in the event that a (correct) functioning of the drive unit 310 is impaired or if the drive unit 310 is not working. For example, the fail-safe device 312 can be activated by an interruption of the power supply and/or of the compressed air supply and/or by an overload of the compressor 100. The safety position can correspond to the first position of the adjustment mechanism 200 or to the second position of the adjustment mechanism. The fail-safe device 312 is preferably designed to move the adjustment mechanism 200 into the first position in which the inlet cross section 112*a* is maximal. In other words, the safety position preferably corresponds to the first position of the adjustment mechanism 200 or rather the open position of the adjustment mechanism 200. The fail-safe device 312 can comprise, for example, a spring element, which pretensions the adjustment mechanism 200 and/or the drive unit 310 in a position. In the example of FIG. 3, the fail-safe device 312 is coupled to the drive unit 310.

In the example of FIG. 6B, the fail-safe device 312 is coupled to the adjustment mechanism 200 or to the adjustment ring 210. A combined coupling to the drive unit 310 and to the adjustment mechanism 200 is also possible. If the fail-safe device 312 is coupled to the drive unit 310, the fail-safe device 312 can be designed to move the coupling unit 320 in such a way that the coupling unit 320 in turn moves the adjustment mechanism 200 into the safety position. If the fail-safe device 312 is coupled to the adjustment mechanism 200, the adjustment mechanism 200 can also be moved into the safety position independently of the coupling unit 320 and/or the drive unit 310 in the event of, say, a defect in the coupling unit 320, in particular a breakage of the coupling unit 320.

The drive unit 310 can be arranged directly on, in particular fastened to, the compressor housing 110. To this end, the compressor housing 110 can be provided with a corresponding flange 119 (see FIG. 7), on which the drive unit 310 can be mounted. Optionally, the flange 119 can comprise a gasket groove 119*a* with an O-ring 119*b*. Leakage can thus be prevented or at least limited.

The actuator device furthermore comprises a (not illustrated) control unit. The control unit can be designed to control the drive unit 310 according to various operation modes of the compressor 100.

Figure 8:
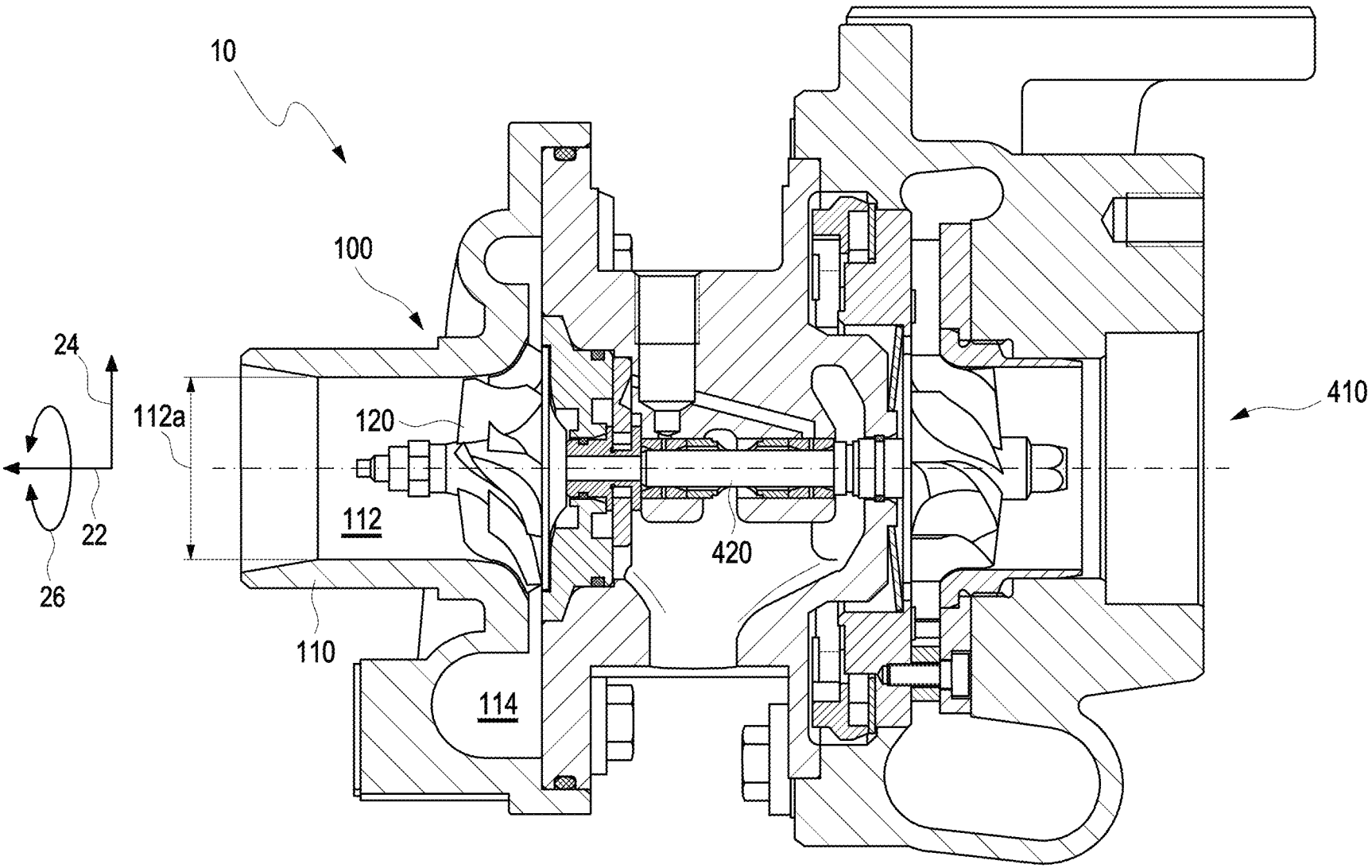
FIG. 8 shows a schematic representation of a supercharger.

The invention furthermore relates to a supercharger 10, which comprises a drive device 410 and a shaft 420 (see FIG. 8). The supercharger 10 furthermore comprises the compressor 100 described further above. The compressor 100 is coupled to the drive device 410, for conjoint rotation therewith, via the shaft 420. More precisely, the compressor wheel 120 of the compressor 100 is coupled to the drive unit 410 via the shaft 420. The drive device 410 comprises a turbine. As an alternative or in addition, the drive device 410 can comprise an electric motor. Even though this is simply not illustrated in FIG. 8, the compressor 100 comprises the adjustment mechanism 200 and the actuator device 300.

Although this invention has been described above and is defined in the appended claims, it should be understood that as an alternative, the invention can also be defined according to the following embodiments:

1. A compressor (100) for a supercharger (10), comprising:
   a compressor housing (110) with a compressor inlet (112) and a compressor outlet (114),
   an adjustment mechanism (200) having an adjustment ring (210) and multiple shutter elements (220) for changing an inlet cross section (112*a*) of the compressor inlet (112), and
   an actuator device (300) having a drive unit (310) and a coupling unit (320), wherein the actuator device (300) is coupled, via the coupling unit (320), to the adjustment mechanism (200) in order to move the adjustment mechanism (200) between a first position and a second position.
2. The compressor (100) according to Embodiment 1, wherein the coupling unit (320) comprises an oblong base body (322) with a first end section (324) and a second end section (326), wherein the first end section (324) is coupled to the drive unit (310) and the second end section (326) is coupled to the adjustment mechanism (200).
3. The compressor (100) according to Embodiment 2, wherein the drive unit (310) is designed to move the coupling unit (320) linearly along an axis (322*a*) of the oblong base body (322) between a first position and a second position.
4. The compressor (100) according to Embodiment 2, wherein the drive unit (310) is designed to move the coupling unit (320) rotationally along an axis (322*a*) of the oblong base body (322) between a first position and a second position.
5. The compressor (100) according to either one of Embodiments 3 or 4, wherein the second end section (326) engages with the adjustment mechanism (200) in such a way that the adjustment mechanism (200) is in its first position in the first position of the oblong base body (322) and that the adjustment mechanism (200) is in its second position in the second position of the oblong base body (322).
6. The compressor (100) according to any one of Embodiments 2 to 5, wherein at least one stop (116) is provided on the compressor housing (110), which limits a movement of the coupling unit (320) and/or a movement of the adjustment mechanism (200), in particular a movement of the adjustment ring (210), in the first position and/or in the second position.
7. The compressor (100) according to any one of Embodiments 1 to 5, wherein the adjustment mechanism (200) comprises at least one stop (116), which limits a movement of the shutter elements (220) and/or of the adjustment ring (210) in the first position and/or in the second position.
8. The compressor (100) according to any one of the preceding embodiments, wherein the first position corresponds to an open position of the adjustment mechanism (200) in which the inlet cross section (112*a*) is maximal and wherein the second position corresponds to a closed position of the adjustment mechanism (200) in which the inlet cross section (112*a*) is reduced.
9. The compressor (100) according to any one of the preceding embodiments, wherein the drive unit (310) is a pneumatic, a hydraulic or an electric drive unit (310) and optionally, if the drive unit (310) is pneumatic, wherein the drive unit (310) is fluidically coupled to a line section (318) downstream of the compressor outlet (314).
10. The compressor (100) according to any one of the preceding embodiments, further comprising a fail-safe device (312) which is designed to move the adjustment mechanism (200) into a safety position and hold it therein.

11. The compressor (100) according to Embodiment 10, wherein the safety position corresponds to the first position of the adjustment mechanism (200) or to the second position of the adjustment mechanism (200).

12. The compressor (100) according to either one of Embodiments 10 or 11, wherein the fail-safe device (312) is coupled to the drive unit (310) and/or to the adjustment mechanism (200), in particular to the adjustment ring (210).

13. The compressor (100) according to any one of the preceding embodiments if dependent on Embodiment 2, wherein the second end section (326) is in direct operative engagement with the adjustment ring (210) or in direct operative engagement with one of the shutter elements (220).

14. The compressor (100) according to any one of the preceding embodiments if dependent on Embodiment 3, wherein the second end section (326) comprises one of a recess (212) or a protrusion (214) and the adjustment ring (210) comprises the other of the recess (212) or protrusion (214), wherein the recess and the protrusion are in operative engagement with each other.

15. The compressor (100) according to Embodiment 14, wherein the recess (212) extends orthogonally to the axis (322*a*) of the oblong base body and orthogonally to the compressor axis (22) if the second end section (326) comprises the recess (212), or the recess extends in a radial direction (24) if the adjustment ring (210) comprises the recess (212).

16. The compressor (100) according to any one of the preceding embodiments if dependent on Embodiment 3, wherein the second end section (326) comprises a three-joint mechanism (327), which is operatively coupled to the adjustment ring (210) and designed to convert a linear movement of the coupling unit (320) into a rotary movement of the adjustment ring (210).

17. The compressor (100) according to any one of the preceding embodiments if dependent on Embodiment 3, wherein the compressor housing (110) comprises a drilled hole (117) through which the oblong base body (322) enters the compressor housing (110), and optionally wherein a bushing (118), in which the oblong base body slides (322), is arranged in the drilled hole (117).

18. The compressor (100) according to Embodiment 17, wherein the drilled hole (117) is arranged in a tangential direction (28).

19. The compressor (100) according to any one of the preceding embodiments if dependent on Embodiment 4, wherein the second end section (326) is fork-shaped or pin-shaped and projects radially away from the axis (322*a*) of the oblong base body (322), and wherein the second end section (326) operatively engages with a corresponding recess (212) in the adjustment ring (210) or with a corresponding protrusion (214) of the adjustment ring (210).

20. The compressor (100) according to any one of the preceding embodiments if dependent on Embodiment 4, wherein the first end section (324) comprises a lever (324*a*) and a rod (325) coupled thereto, wherein the lever (324*a*) projects radially away from the axis (322*a*) of the oblong base body (322) and wherein the rod (325) is coupled directly to the drive unit (310) in such a way that the rod (325) is moved linearly along its axis (325*a*) by the drive unit (310).

21. The compressor (100) according to any one of Embodiments 1 to 18 if dependent on Embodiment 4, wherein the drive unit (310) is designed to generate a rotary movement and wherein the first end section (324) is coupled directly to the drive unit (310) and is designed to receive a rotary movement.

22. The compressor (100) according to any one of the preceding embodiments if dependent on Embodiment 4, wherein the compressor housing (110) comprises a drilled hole (117) through which the oblong base body (312) enters the compressor housing (110), and optionally wherein a bushing (118), in which the oblong base body (312) is rotatably mounted, is arranged in the drilled hole (117).

23. The compressor (100) according to Embodiment 22, wherein the drilled hole (117) is arranged in a radial direction (24) or in an axial direction (22).

24. The compressor (100) according to any one of the preceding embodiments, wherein the drive unit (310) is arranged directly on, in particular fastened to, the compressor housing (110).

25. The compressor (100) according to any one of the preceding embodiments, wherein the actuator device (300) furthermore comprises a control unit (330), which controls the drive unit (310) in accordance with various operating modes of the compressor (300).

26. A supercharger (10) comprising:

a drive device (410) and a compressor (100) according to any one of the preceding embodiments, wherein the compressor (100) is coupled via a shaft (420) to the drive device (410) for conjoint rotation therewith.

27. The supercharger (10) according to Embodiment 26, wherein the drive device (410) comprises a turbine and/or an electric motor.

The invention claimed is:

1. A compressor (100) for a supercharger (10), comprising:

a compressor housing (110) having a compressor inlet (112) and a compressor outlet (114), an adjustment mechanism (200) having an adjustment ring (210) and multiple shutter elements (220) for changing an inlet cross section (112*a*) of the compressor inlet (112), and an actuator device (300) having a drive unit (310) and a coupling unit (320), wherein the actuator device (300) is coupled, via the coupling unit (320), to the adjustment mechanism (200) in order to move the adjustment mechanism (200) between a first position and a second position, wherein the adjustment mechanism (200) comprises at least one stop (116), which limits a movement of the shutter elements (220) and/or of the adjustment ring (210) in the first position and/or in the second position.

2. The compressor (100) according to claim 1, wherein the coupling unit (320) comprises an oblong base body (322) with a first end section (324) and a second end section (326), wherein the first end section (324) is coupled to the drive unit (310) and the second end section (326) is coupled to the adjustment mechanism (200).

3. The compressor (100) according to claim 2, wherein the drive unit (310) is designed to move the coupling unit (320) linearly along an axis (322*a*) of the oblong base body (322) between a first position and a second position.

4. The compressor (100) according to claim 3, wherein the second end section (326) comprises one of a recess (212) and a protrusion (214) and the adjustment ring (210) comprises the other of the recess (212) and the protrusion (214), wherein the recess and the protrusion are in operative engagement with each other.

5. The compressor (100) according to claim 4, wherein the recess (212) extends orthogonally to the axis (322*a*) of the oblong base body and orthogonally to the compressor axis (22) if the second end section (326) comprises the recess (212), or the recess (212) extends in a radial direction (24) if the adjustment ring (210) comprises the recess (212).

6. The compressor (100) according to claim 2, wherein the drive unit (310) is designed to move the coupling unit (320) rotationally along an axis (322*a*) of the oblong base body (322) between a first position and a second position.

7. The compressor (100) according to claim 6, wherein the second end section (326) is fork-shaped or pin-shaped and projects radially away from the axis (322*a*) of the oblong base body (322), and wherein the second end section (326) operatively engages with a corresponding recess (212) in the adjustment ring (210) or with a corresponding protrusion (214) of the adjustment ring (210).

8. The compressor (100) according to claim 6, wherein the first end section (324) comprises a lever (324*a*) and a rod (325) coupled thereto, wherein the lever (324*a*) projects radially away from the axis (322*a*) of the oblong base body (322) and wherein the rod (325) is coupled directly to the drive unit (310) in such a way that the rod (325) is moved linearly along its axis (325*a*) by the drive unit (310).

9. The compressor (100) according to claim 6, wherein the compressor housing (110) comprises a drilled hole (117) through which the oblong base body (322) enters the compressor housing (110), and optionally wherein a bushing (118), in which the oblong base body (322) is rotatably mounted, is arranged in the drilled hole (117), and optionally wherein the drilled hole (117) is arranged in a radial direction (24) or in an axial direction (22).

10. The compressor (100) according to claim 1, wherein the first position corresponds to an open position of the adjustment mechanism (200) in which the inlet cross section (112*a*) is maximal and wherein the second position corresponds to a closed position of the adjustment mechanism (200) in which the inlet cross section (112*a*) is reduced.

11. The compressor (100) according to claim 1, wherein the drive unit (310) is arranged directly on the compressor housing (110).

12. The compressor (100) according to claim 11, wherein the drive unit (310) is fastened to the compressor housing (110).

13. The supercharger (10) comprising:

a drive device (410) and the compressor (100) according to claim 1, wherein the compressor (100) is coupled via a shaft (420) to the drive device (410) for conjoint rotation therewith.

14. A compressor (100) for a supercharger (10), comprising:

a compressor housing (110) having a compressor inlet (112) and a compressor outlet (114), an adjustment mechanism (200) having an adjustment ring (210) and multiple shutter elements (220) for changing an inlet cross section (112*a*) of the compressor inlet (112), and an actuator device (300) having a drive unit (310) and a coupling unit (320), wherein the actuator device (300) is coupled, via the coupling unit (320), to the adjustment mechanism (200) in order to move the adjustment mechanism (200) between a first position and a second position, furthermore, comprising a fail-safe device (312) which is designed to move the adjustment mechanism (200) into a safety position and hold it therein.

15. A compressor (100) for a supercharger (10), comprising:

a compressor housing (110) having a compressor inlet (112) and a compressor outlet (114), an adjustment mechanism (200) having an adjustment ring (210) and multiple shutter elements (220) for changing an inlet cross section (112*a*) of the compressor inlet (112), and an actuator device (300) having a drive unit (310) and a coupling unit (320), wherein the actuator device (300) is coupled, via the coupling unit (320), to the adjustment mechanism (200) in order to move the adjustment mechanism (200) between a first position and a second position, wherein the coupling unit (320) comprises an oblong base body (322) with a first end section (324) and a second end section (326), wherein the first end section (324) is coupled to the drive unit (310) and the second end section (326) is coupled to the adjustment mechanism (200), wherein the drive unit (310) is designed to move the coupling unit (320) linearly along an axis (322*a*) of the oblong base body (322) between a first position and a second position, wherein the second end section (326) comprises a three-joint mechanism (327), which is operatively coupled to the adjustment ring (210) and designed to convert a linear movement of the coupling unit (320) into a rotary movement of the adjustment ring (210).

* * * * *